US010544773B2

(12) United States Patent
Hoban et al.

(10) Patent No.: US 10,544,773 B2
(45) Date of Patent: Jan. 28, 2020

(54) SPARKPLUG HEALTH DETERMINATION IN ENGINE IGNITION SYSTEM

(71) Applicant: Caterpillar Inc., Peoria, IL (US)

(72) Inventors: William Hoban, Dunlap, IL (US); Morteza Rezaei, Peoria, IL (US); Ioan Paduret, Peoria, IL (US); James Siegle, Washington, IL (US)

(73) Assignee: Caterpillar Inc., Peoria, IL (US)

( * ) Notice: Subject to any disclaimer, the term of this patent is extended or adjusted under 35 U.S.C. 154(b) by 271 days.

(21) Appl. No.: 15/141,206

(22) Filed: Apr. 28, 2016

(65) Prior Publication Data

US 2017/0314524 A1 Nov. 2, 2017

(51) Int. Cl.
*F02P 17/12* (2006.01)
*F02P 17/02* (2006.01)

(52) U.S. Cl.
CPC ..... *F02P 17/12* (2013.01); *F02P 17/02* (2013.01)

(58) Field of Classification Search
CPC ..... F02P 17/12; F02P 2017/121; F02P 2017/123; F02P 2017/125; F02P 11/06; F02P 17/00; F02P 11/00; F02P 11/02; F02P 11/04
See application file for complete search history.

(56) References Cited

U.S. PATENT DOCUMENTS 4,377,785 A * 3/1983 Ueno ..... F02P 3/0442 324/378
4,446,842 A * 5/1984 Iwasaki ..... F02P 3/01 123/169 PA
4,449,100 A * 5/1984 Johnson ..... F02P 17/00 324/378
5,043,900 A 8/1991 Allen
5,196,760 A * 3/1993 Takamura ..... H01T 13/20 313/141
5,208,540 A * 5/1993 Hoeflich ..... F02P 3/096 123/644
5,283,527 A 2/1994 Debiasi
6,492,818 B1 12/2002 Downs
6,600,322 B1 * 7/2003 Nussbaum ..... F02P 3/06 123/406.3
9,080,509 B2 7/2015 Huberts
2002/0056445 A1 * 5/2002 Inagaki ..... F02P 3/0456 123/609
2002/0144544 A1 * 10/2002 Kesler ..... G01M 15/11 73/114.12
2013/0199485 A1 * 8/2013 Shibata ..... F02P 17/12 123/146.5 R (Continued)

FOREIGN PATENT DOCUMENTS

CN 1184942 6/1998

*Primary Examiner* — Grant Moubry
*Assistant Examiner* — Ruben Picon-Feliciano
(74) *Attorney, Agent, or Firm* — Mattingly Burke Cohen & Biederman

(57) ABSTRACT

An engine ignition system for a spark-ignited engine includes a sparkplug and a control system having primary ignition circuitry, secondary ignition circuitry coupled with electrodes of the sparkplug, and sensing circuitry. A control device determines a timing of spark production based on a pattern of varying of an electrical property in the primary ignition circuitry. An inflection point in a sensed current signal may be detected to determine the timing.

13 Claims, 4 Drawing Sheets

(56) References Cited

U.S. PATENT DOCUMENTS

| | | | | |
|---|---|---|---|---|
| 2013/0206106 | A1* | 8/2013 | Huberts | F02B 77/08<br>123/406.27 |
| 2015/0340846 | A1 | 11/2015 | Schultz | |
| 2016/0138553 | A1* | 5/2016 | Senior | G01M 15/11<br>73/114.62 |

* cited by examiner

SPARKPLUG HEALTH DETERMINATION IN ENGINE IGNITION SYSTEM

TECHNICAL FIELD

The present disclosure relates generally to a technique for monitoring sparkplug health, and more particularly to detecting a timing of spark production by way of sensing an electrical property in a primary ignition circuit.

BACKGROUND

A variety of engine performance monitoring and diagnostic routines have been proposed over the years. Most modern engines, and machines generally, have routine maintenance schedules where the engine or machine is brought in for service and various parts are tested, cleaned, inspected, repaired, and potentially replaced. On-board diagnostics and the like can enable operators and owners to be easily alerted to needed servicing prior to the next scheduled maintenance. Such diagnostics can also be of value in the validation of changed specifications or in analysis as to whether service intervals are in fact optimally scheduled.

Those skilled in the art will be familiar with the general desirability of scheduling routine maintenance relatively infrequently. In other words, since an engine is removed from service for a time whenever maintenance is needed, certain operations where the engine is ordinarily used may need to be idled or may otherwise be inconvenienced. Moreover, owners typically desire their machines to be operating as much of the time as is practicable. A typical example is an electrical power genset which can operate most of the hours of the day or continuously, but must be taken off-line for inspection and/or replacement of many different components. To be conservative, manufacturers typically schedule routine maintenance relatively frequently so as to prevent otherwise avoidable unscheduled downtime when unexpected breakdowns or the like occur. Improved diagnostics can improve engineers' understanding of when service is really needed, and can better warn operators and owners when something appears to be amiss outside of routine maintenance schedules. In the case of certain components and subsystems, such as engine electrical systems used in spark-ignited engines, it can be desirable to understand when sparkplug failure is expected prior to such failure actually occurring. Commonly owned United States Patent Application Publication No. 2015/0340846 to Schultz et al. is directed to a detection system for determining spark voltage. For example, Schultz et al. is directed to detecting a spark time based on a signal indicating that a voltage, on a low side of a primary coil, exceeds a threshold.

SUMMARY

In one aspect, a method of determining sparkplug health in an engine ignition system includes energizing a primary ignition circuit so as to inductively energize a secondary ignition circuit to produce a spark between electrodes in a sparkplug coupled with the energized secondary ignition circuit, and sensing an electrical property of the primary ignition circuit that varies based on the production of the spark. The method still further includes flagging the sparkplug for service based on a pattern of varying of the electrical property, the pattern being indicative of a timing of the spark production.

In another aspect, an engine ignition control system includes primary ignition circuitry having an electrical input configured to couple with an electrical energy supply, and electrical outputs configured to energize secondary ignition circuitry for a sparkplug. The system further includes sensing circuitry coupled with the primary ignition circuitry and configured to sense an electrical property therein that varies based on production of a spark between electrodes of the sparkplug when the secondary ignition circuitry is energized. The system still further includes a control device coupled with the sensing circuitry and configured to produce a control signal indicative indicative of an aging state of the sparkplug based on a pattern of varying of the sensed electrical property, the pattern being indicative of a timing of the spark production.

In still another aspect, an engine ignition system includes a fluid conduit configured to convey a mixture of a fuel and air for combustion, and a sparkplug including electrodes forming a spark gap positioned within the fluid conduit. The system further includes an ignition control system including primary ignition circuitry, secondary ignition circuitry coupled with the electrodes, and sensing circuitry coupled with the primary ignition circuitry and configured to sense an electrical property of the primary ignition circuitry that varies based on production of a spark between the electrodes. The ignition control system still further includes a control device coupled with the sensing circuitry, and the control device being configured to determine a timing of the production of the spark based on a pattern of varying of the sensed electrical property.

DETAILED DESCRIPTION

Figure 1:
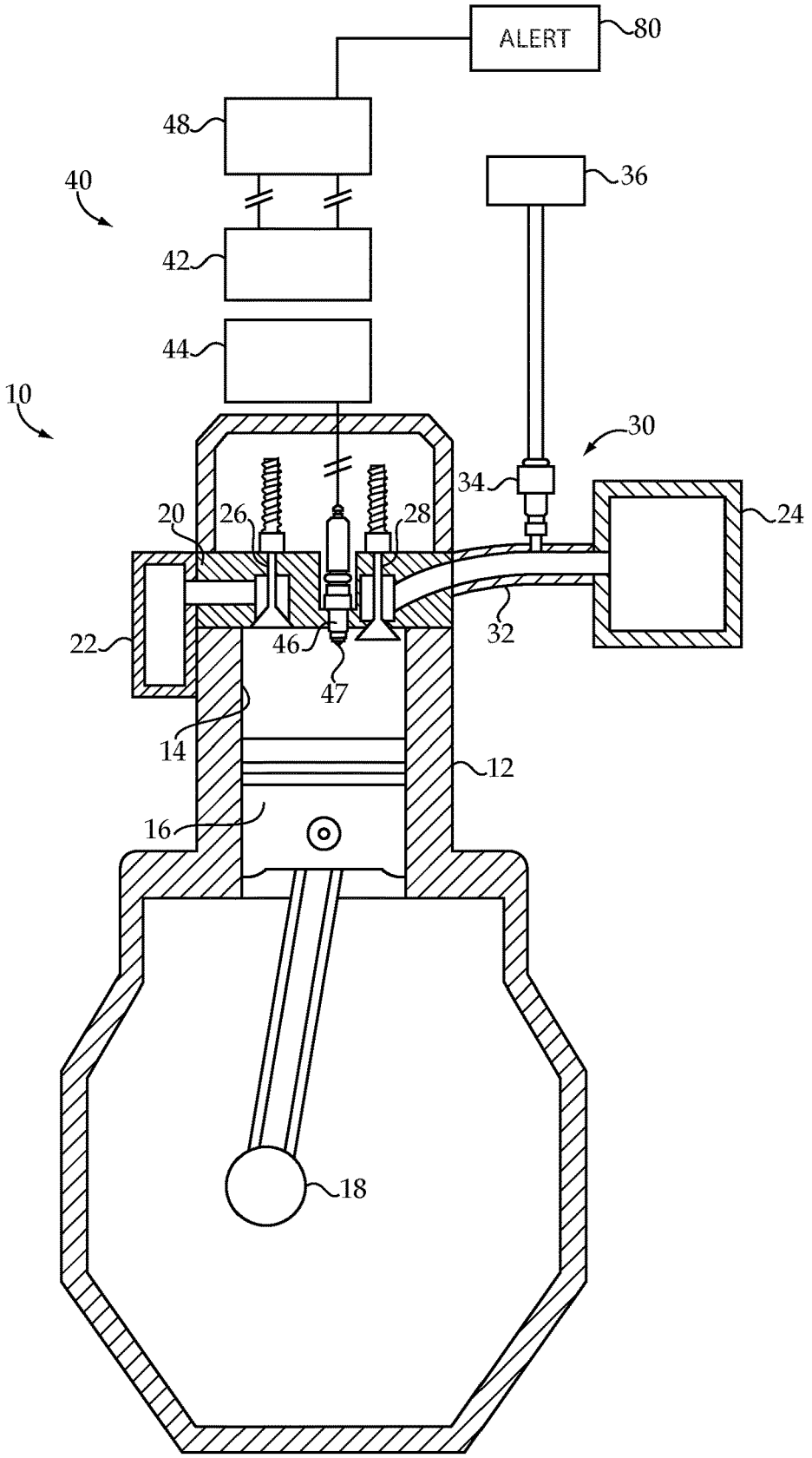
FIG. 1 is a partially sectioned side diagrammatic view of an engine and ignition system, according to one embodiment.

Referring to FIG. 1, there is shown an internal combustion engine 10 (or "engine 10") according to one embodiment. Engine 10 includes an engine housing 12 having a cylinder 14 formed therein, an engine head 20, and a piston 16 coupled with a crankshaft 18 and movable within cylinder 14 in a generally conventional manner. Engine 10 may include a plurality of cylinders each having a piston movable therein to compress a mixture of air and a fuel, although only a single cylinder and piston set is shown. The cylinders and pistons could be arranged within housing 12 in any suitable manner, such as a V-configuration, an in-line configuration, an opposed configuration, for example. In some implementations, engine 10 further includes an intake manifold 24 configured to receive incoming air for combustion, and a fluid conduit in the nature of an intake runner 32 configured to convey the intake air into cylinder 14. An exhaust manifold 22 is coupled with engine housing 12 and configured to convey exhaust discharged from cylinder 14. A first engine valve 26 is movable to control fluid communication between cylinder 14 and exhaust manifold 22. A second engine valve 28 is movable to control fluid communication between cylinder 14 and intake manifold 24.

In some implementations, engine 10 is a gaseous fuel spark-ignited engine where an ignition system 30 (or "system 30") of the gaseous fuel spark-ignited engine includes intake runner 32, a fuel injector 34, a gaseous fuel supply 36 containing compressed or liquefied natural gas, for instance, and a sparkplug 46. Each of a plurality of cylinders of engine 10 could be equipped analogously to cylinder 14, as depicted in FIG. 1, so as to include a similar or identical cylinder configuration and similar or identical hardware. Sparkplug 46 includes electrodes 47 defining a spark gap positioned within cylinder 14 so as to controllably ignite a mixture of gaseous fuel and air in cylinder 14. An ignition control system 40 (or "control system 40" or "system 40") includes a primary ignition circuit (or "circuitry 42"), a secondary ignition circuit (or "circuitry 44") inductively coupled with primary ignition circuitry 42, and a control device 48. Control device 48 is in communication with primary ignition circuitry 42 and circuit elements thereof, and secondary ignition circuitry 44 is coupled with electrodes 47. Those skilled in the art will be generally familiar with energizing of ignition circuitry so as to produce a combustion-initiating spark within an engine cylinder. As will be further apparent from the following description, the present disclosure provides insights into the electrical behavior of ignition system 30 during ignition so as to detect a timing of production of a spark by way of sparkplug 46. A timing of production of a spark can be indicative of an aging state of a sparkplug and thus indicative of where a sparkplug is in its theoretical and actual service life. In a manner further discussed herein, when it is determined that sparkplug 46 is approaching an end of its service life, as indicated by its time to spark, an alert 80 can be activated such as illuminating a check engine light or the like. In the case of a mobile machine powered by way of engine 10, alert 80 could be a light indicator located in an operator cab of the machine. Alert 80 could also be a light on an instrument panel or operator interface for an engine in a genset, or any other conceivable operator-perceptible or operator-imperceptible mechanism depending upon the application. In either case, if it is determined criteria are met for servicing sparkplug 46 by way of inspection and/or replacement, sparkplug 46 may be flagged for servicing. Control device 48, for example, could set a flag in computer memory that is associated with a particular sparkplug in engine 10. Rather than action only toward the end of a service life, a flag could be set at other aging states as desired, such as at a 25% aging state, a 50% aging state, a 75% aging state, and so on.

Figure 2:
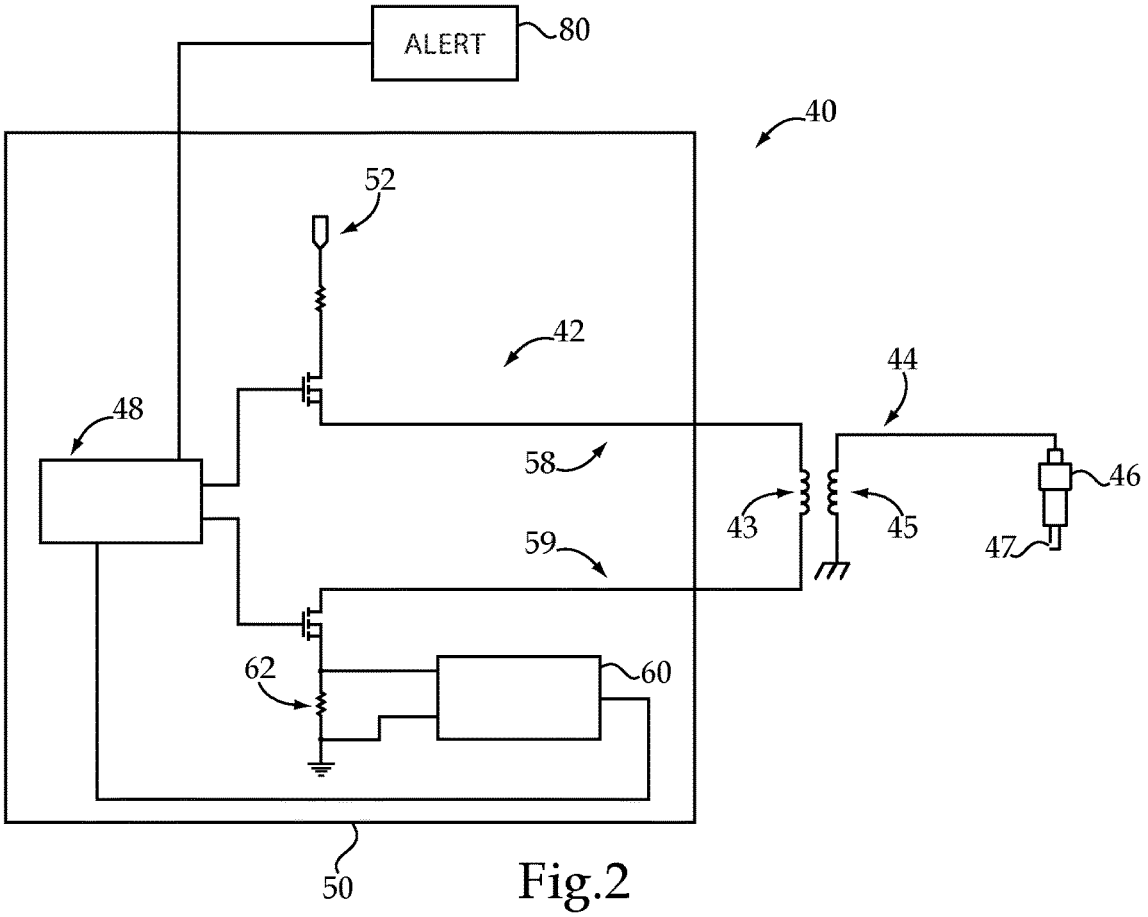
FIG. 2 is a schematic view of an engine ignition control system, according to one embodiment.

Referring also now to FIG. 2, there are shown schematically additional example features of engine ignition control system 40. In some implementations at least some of the electrical components of control system 40 can be resident on a control module 50, although the present disclosure is not thereby limited. As shown in FIG. 2, ignition circuitry that includes at least some of primary ignition circuitry 42 is resident on control module 50, and includes an electrical input 52 configured to couple with an electrical energy supply, such as a battery. Primary ignition circuitry 42 further includes electrical outputs configured to energize secondary ignition circuitry 44. A high side electrical output is shown by way of reference numeral 58, whereas a low side electrical output is shown by way of reference numeral 59. These same reference numerals 58 and 59 can be understood to refer generally to a high side and low side of primary ignition circuit 42, respectively. In a practical implementation strategy primary ignition circuitry 42 includes a primary ignition coil 43 that is positioned adjacent to a secondary ignition coil 45 of secondary ignition circuitry 44. Energizing primary ignition circuitry 42 inductively energizes secondary ignition circuitry 44 and can step up the voltage according to well-known principles.

Figure 3:
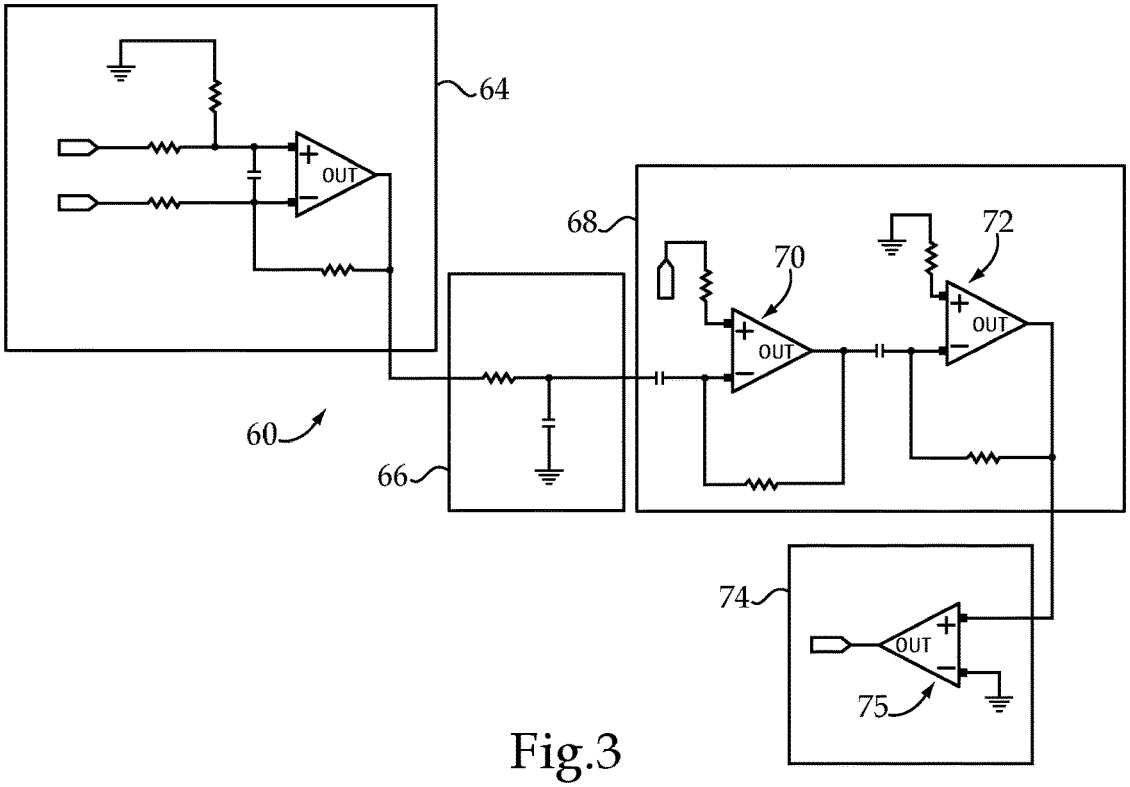
FIG. 3 is a schematic view of sensing circuitry for an engine ignition control system, according to one embodiment.

It will be recalled that control system 40 is configured to determine time to spark of sparkplug 46. To this end, control system 40 further includes sensing circuitry 60 coupled with primary ignition circuitry 42 and configured to sense an electrical property of primary ignition circuitry 42 that varies in response to production of a spark between electrodes 47. In some implementations, the sensed electrical property is electrical current, sensed on a low side of primary ignition circuitry 42. A current sense resistor 62 is coupled with electrical output 56, and sensing circuitry 60 may be connected to opposite sides of current sense resistor 62. Referring also now to FIG. 3 there are shown features of sensing circuitry 60 in greater detail. Sensing circuitry 60 may include an amplifier block 64 that connects to current sense resistor 62 and amplifies a signal indicative of or corresponding to electrical current in circuitry 42. A filter block 66 is connected with amplifier block 64 and provides a low-pass filter to filter an output of amplifier block 64. A differentiation block 68 is connected with filter block 66 and includes a first differentiator 70 and a second differentiator 72 coupled in series with first differentiator 70. In some implementations each of differentiators 70 and 72 is an operational amplifier-based differentiator. First differentiator 70 differentiates a sensor signal indicative of an amplitude of the sensed electrical property as produced from filter block 66. Second differentiator 72 calculates a second derivative of the differentiated signal from second differentiator 72. Sensing circuitry 60 further includes a comparator block 74 that includes a comparator 75 coupled with second differentiator 72. A comparator output, of comparator 75, may be dependent upon a value of the second derivative. Comparator 75 may be configured to compare a differentiated value of the sensor signal, for instance a second derivative, with a predefined value and to toggle the output of comparator 75 to produce a spark detection signal based on a second derivative value of approximately zero.

It will be recalled that the sensed electrical property varies based on production of a spark (or spark production) between electrodes 47. The manner in which the sensed electrical property varies can be indicative of characteristics of the spark production. In particular, a pattern of the varying in the sensed electrical property can be indicative of a timing of the spark production. Thus, by monitoring the sensed electrical property, a timing of spark production can be determined, which in turn can be indicative of an aging state of sparkplug 46. As a sparkplug ages a time duration required to generate a spark at least under consistent operational conditions can increase. Thus, older sparkplugs, or sparkplugs having been subjected to a relatively greater number of operating cycles, can take longer to spark, and in some instance require a higher voltage to spark, than relatively newer sparkplugs or sparkplugs having been subjected to a relatively lesser number of operating cycles.

Control device 48 may be coupled with sensing circuitry 60 and configured to produce a control signal indicative of an aging state of sparkplug 46 based on a pattern of the varying of the sensed electrical property that is indicative of a timing of spark production. Control device 48 may be or include a field programmable gate array (FPGA) in one embodiment, but could include another computing or calculation device in other embodiments. Control device 48 could also include multiple devices such as an FPGA configured to execute certain logic functions and also a microprocessor configured to execute other logic functions in the operation of control system 40. It should be appreciated that control system 40 might broadly produce a signal that is indicative of a timing of spark production, and be further configured to process that timing of spark production information so as to determine a time to spark. The time to spark can be understood as a time duration between energizing primary ignition circuitry 42 to a time of the spark production. Control device 48 may be further configured to clock a time duration from energizing primary ignition circuitry 42 to the spark production, and to produce the control signal based on the clocked time duration. For instance, control device 48 may be configured to control switching elements (not numbered) in the nature of transistor switches in ignition circuitry 42 so as to selectively connect and disconnect primary ignition coil 43 from an electrical energy supply, and also to selectively connect and disconnect sense resistor 62 and sensing circuitry 60.

The control signal indicative of aging state can be understood as a signal that is indicative of whether a sparkplug is a certain portion through an expected service life (e.g. 50% of the way through an expected service life, 25% of the way through an expected service life, or 99% of the way through an expected service life). Correlation between a time to spark and an aging state can be determined empirically for any given system or class of systems. The actual determination for purposes of producing the control signal can include comparing a time to spark with a plurality of stored times indicative of a plurality of different aging states. The comparison could be performed by control device 48/FPGA or by another computing device running application software for engine operation, for example. In some implementations, control device 48 may be further configured to set a flag for servicing sparkplug 46 based on the control signal. The flag may include one or more bits of information that indicates a first aging state of a given sparkplug (the sparkplug need not be replaced) or a second aging state of the given sparkplug (the sparkplug needs to be replaced or is old). In some implementations, different flags could be set depending upon where in a service life a particular sparkplug is deemed to be. For example, a first flag could be set at a 25% aging state, a second flag set at a 75% aging state, and a third flag set at a 90% aging state. When brought in service a technician could examine the flags and determine whether sparkplug replacement is appropriate, or critical, in parallel with the setting of the flag, control device 48 could activate alert 80, such as by illuminating a check engine light or recording in computer readable memory an aging state of sparkplug 56. In still other instances, it might be desirable to transmit a wireless signal indicative of aging state to a fleet manager or another centralized control and/or monitoring station for a fleet of machines of which engine 10 is a part.

Figure 4:
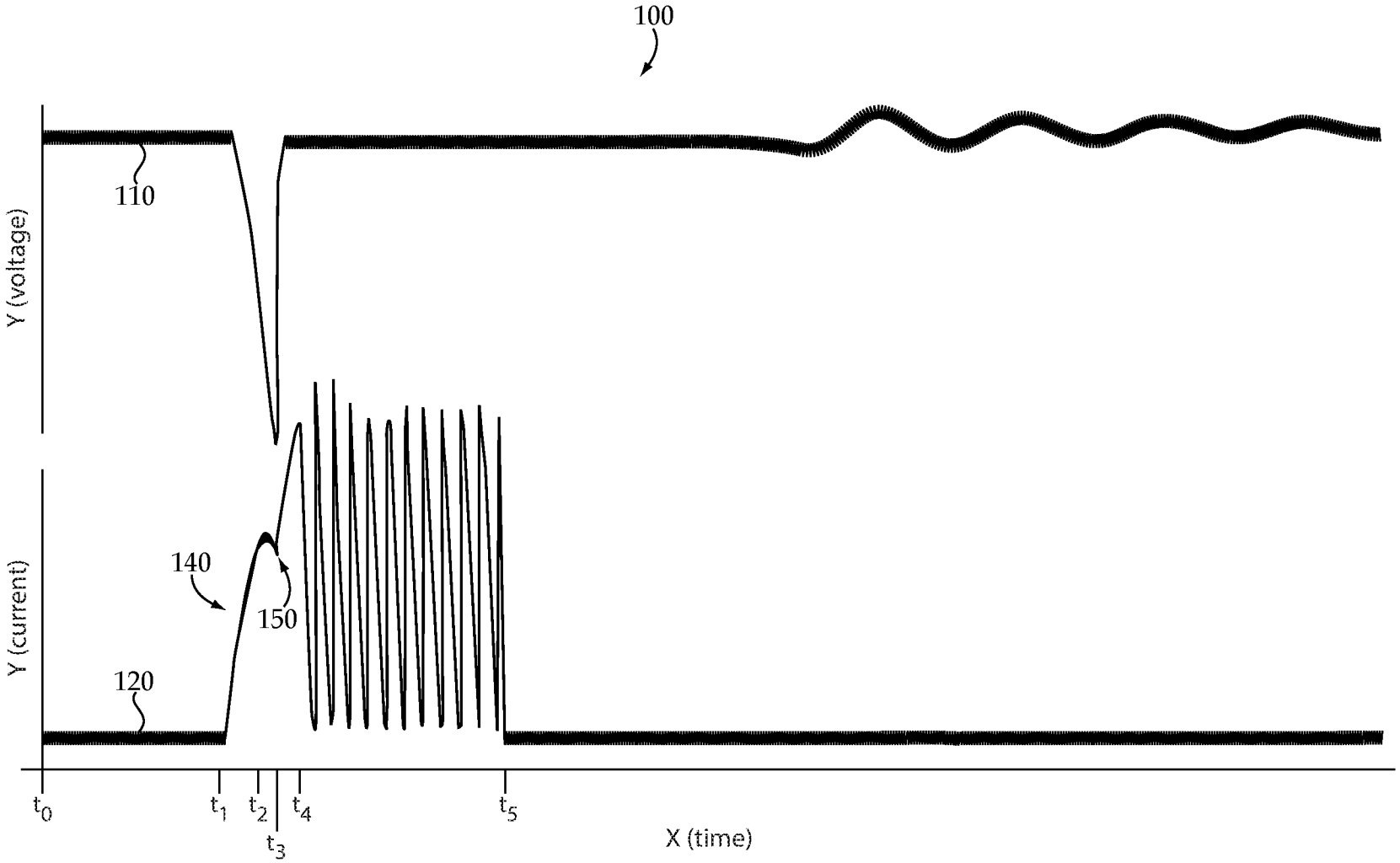
FIG. 4 is a graph illustrating signal traces of a primary side electrical property and a secondary side electrical property in an engine ignition system, according to one embodiment.

Referring now also to FIG. 4, there is shown a graph 100 illustrating a first signal trace 110 in the nature of a voltage in a secondary ignition circuit such as circuitry 44, and another signal trace 120 in the nature of a current in a primary ignition circuit such as primary ignition circuitry 42. It will be recalled that primary ignition circuitry 42 and secondary ignition circuitry 44 are inductively coupled, and a voltage in primary ignition circuitry 42 can induce a voltage in secondary ignition circuitry 44 according to well-known principles. It will also be recalled that an electrical property, in the illustrated case electrical current, in primary ignition circuitry 42 varies in response to production of a spark between electrodes 47. In FIG. 4, a ramp-up 140 in signal trace 120 beginning at about a time $t_1$ is evident, corresponding generally to the energizing of primary ignition circuitry 42. Generally, in response to the energizing of primary ignition circuitry 42, energizing of secondary ignition circuitry 44 and hence voltage in secondary ignition circuitry 44 increases. During ramp-up 140 a voltage potential across electrodes 47 will be understood to be increasing. At approximately a time $t_2$ electrical current 120 amplitude begins to level off, and actually decrease in response to a back electro-motive force (back EMF) in primary ignition circuitry 42. At about a time t3 electrical current 120 suddenly reverses the decrease and begins to increase once again. An inflection point 150 in electrical current 120, or more particularly the signal indicative of electrical current amplitude, is seen where electrical current 120 transitions from decreasing to increasing. It has been discovered that this inflection point 150 at time t3 occurs simultaneously with production of the spark between electrodes 47. Electrical current 120 continues to decrease for a time up to about a time t4 before a series of oscillations and reflections occur and eventually settles back to a more or less steady state.

From FIG. 4 it can be seen that while voltage is induced in secondary ignition circuitry 44 based on energizing primary ignition circuitry 42, electrical current in primary ignition circuitry 42 is likewise varying in response to what is going on in secondary ignition circuitry 44. In particular, it can be seen that the back EMF in circuitry 42 shows a pattern of varying that is indicative of production of the spark, and in particular indicative of a timing of the spark production. In the illustrated example, it can be seen that inflection point 150 provides a relatively robust and readily identifiable point in time. Inflection point 150 itself, at least taken in proper context, can be understood to demonstrate a pattern of varying that is indicative of a timing of production of the spark. At inflection point 150 a second derivative of the signal corresponding to sensed electrical current will be zero. Thus, system 40 can be configured such that comparator 75 compares a calculated value of the second derivative to a predefined value of zero or approximately zero, and toggles its output when the second derivative is approximately zero. A spark detection signal is outputted from comparator 75 and conveyed to control device 48 to be used in determining time to spark and sparkplug aging state as described herein.

From the foregoing description it will be understood that a pattern of varying of electrical current can be exploited according to the present disclosure for on-board sparkplug diagnostics. In addition to or as an alternative to detecting an inflection point, other embodiments where other characteristics such as potentially a slope or change in slope could be used to detect spark production or anticipated spark production. Moreover, while the present description focuses on a single instance of spark production it should be appreciated that practical implementations of the present disclosure will commonly include diagnostics that evaluate time to spark or other properties over numerous operating cycles, perhaps thousands, millions or even billions of instances of spark production, to detect when a sparkplug needs to be serviced.

INDUSTRIAL APPLICABILITY

Figure 5:
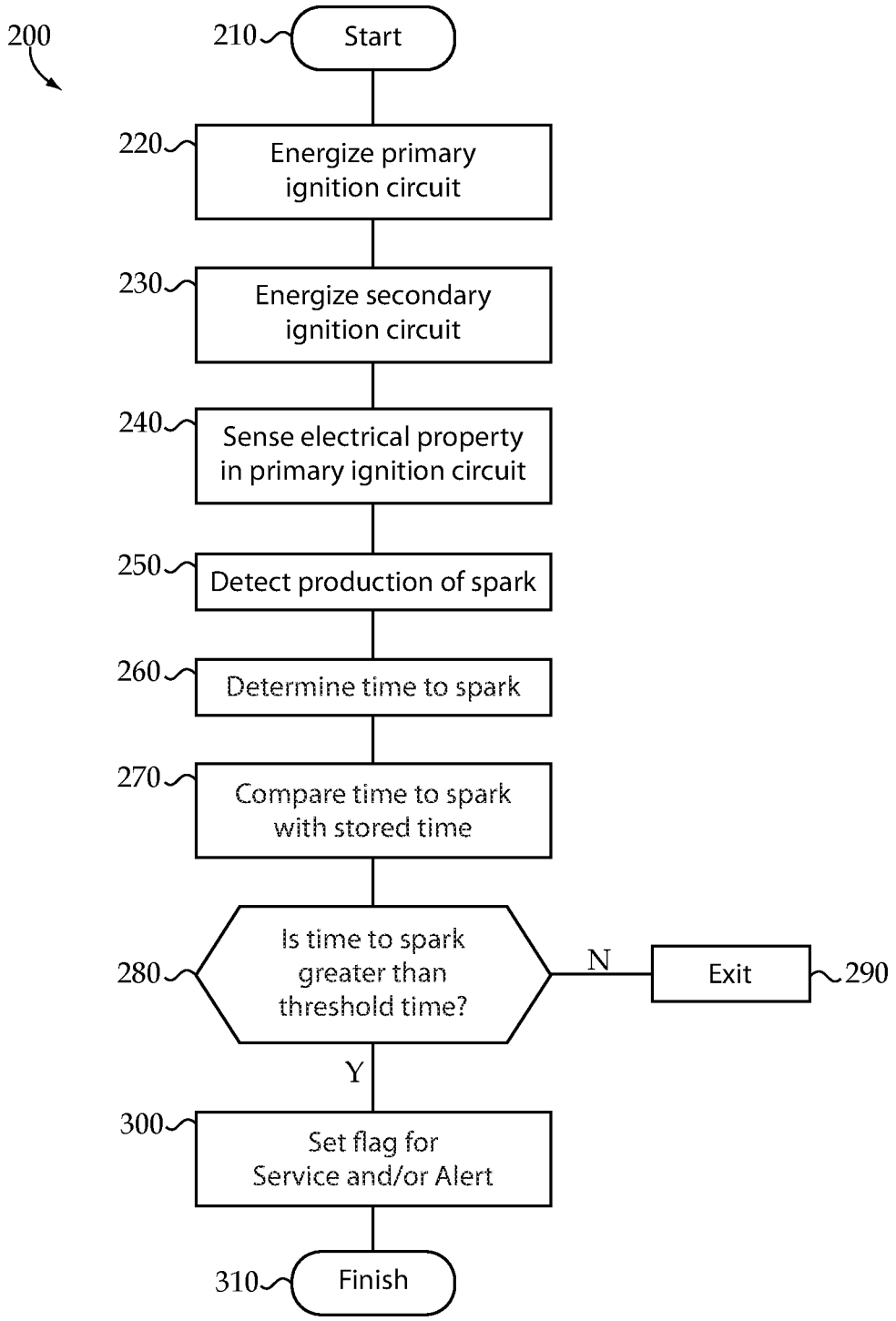
FIG. 5 is a flowchart illustrating example control logic and process flow, according to one embodiment.

Referring to the drawings generally, but in particular now to FIG. 5, there is shown a flowchart 200 illustrating example process and control logic flow according to one embodiment. The process of flowchart 200 commences at an initialize or START block 210, and advances to block 220 to energize primary ignition circuitry 42. As discussed herein, energizing primary ignition circuitry 42 can include connecting primary ignition circuitry 42 to an electrical energy supply. From block 220 the logic may advance to block 230 to energize secondary ignition circuit 44. As discussed herein, energizing circuit 44 occurs by way of electrical induction between coils 43 and 45. From block 230 the logic may advance to block 240 to sense the electrical property in primary ignition circuitry 42, and then to block 250 to detect production of a spark.

From block 250 the logic may advance to block 260 to determine time to spark, and then to block 270 to compare the time to spark with a stored time. As described above, a time known to be associated with a 50%, 75%, 90%, or any other arbitrarily selected aging state of a sparkplug between being first placed in service and an expected failure time or scheduled replacement might be selected. The relationship between such aging states and a time to spark can be empirically determined by way of testing and/or extrapolating, or even potentially by way of modeling. Control device 48 may be configured to clock the time from start of current in primary circuitry 42 to the time of spark as described herein. From block 270 the logic may advance to block 280 to query whether the time to spark is greater than a threshold time. If no, the logic may exit at block 290. If yes, the logic may advance to block 300 to set a flag for service and/or activate alert 80. The logic may FINISH at block 310.

While a relationship between a time to spark and sparkplug aging state has been previously recognized, existing strategies for spark time detection suffer from a number of shortcomings with respect to certain applications. On the one hand, the electrical properties in primary ignition circuitry that are affected by sparking on the secondary side are not readily evident and variations therein may be relatively subtle. Moreover, while certain techniques have been proposed that relate to measuring electrical properties such as voltage and/or current on the secondary side, such an approach would require additional hardware over and above the sensing and testing circuitry that is already resident on many engines. Since the present strategy does not require sensing or monitoring of the secondary circuit no additional hardware apart from what can be integrated in control module 50 is needed.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. Other aspects, features and advantages will be apparent upon examination of the attached drawings and appended claims.

What is claimed is:

1. A method of determining sparkplug health in an engine ignition system comprising:

energizing a primary ignition circuit including a primary ignition coil so as to inductively energize a secondary ignition circuit including a secondary ignition coil to produce a spark between electrodes in a sparkplug coupled with the energized secondary ignition circuit, the primary ignition circuit further including an electrical input coupled with an electrical energy supply, and a first electrical output and a second electrical output connected to the primary ignition coil;

sensing an electrical current in the primary ignition circuit that varies in amplitude based on the production of the spark by way of sensing circuitry connected to the primary ignition circuit, wherein the varying in amplitude includes a pattern of decreasing and then increasing amplitude that is indicative of a timing of the spark production;

producing a sensor signal corresponding to the amplitude of the sensed electrical current;

comparing a differentiated value of the sensor signal with a predefined value;

producing a spark detection signal based on the comparison;

producing a control signal indicative of an aging state of the sparkplug based on the spark detection signal; and activating an alert or flagging the sparkplug for service, based on the control signal; wherein the control device is further configured to: clock a time duration from energizing the ignition circuitry to the production of the spark; and produce the control signal based on the clocked time duration.

2. The method of claim 1 wherein the method includes the flagging of the sparkplug for service, and the flagging further includes flagging the sparkplug based on an inflection point in the sensor signal.

3. The method of claim 1 further comprising differentiating the sensor signal using sensing circuitry connected to the primary ignition circuit.

4. The method of claim 3 further comprising calculating a second derivative of the differentiated signal.

5. The method of claim 4 wherein the predefined value is zero.

6. An engine ignition control system comprising:

a primary ignition circuitry including an electrical input configured to couple with an electrical energy supply, and a first electrical output and a second electrical output, and a primary ignition coil connected to the first and the second electrical outputs, and configured to energize a secondary ignition coil in a secondary ignition circuitry for a sparkplug by way of inductive coupling of the primary ignition coil to the secondary ignition coil;

sensing circuitry connected to the primary ignition circuitry and configured to sense an electrical current in the primary ignition circuitry that varies in amplitude based on production of a spark between electrodes of the sparkplug when the secondary ignition circuitry is energized;

the varying in amplitude including a pattern of decreasing and then increasing amplitude that is indicative of a timing of the spark production, and the sensing circuitry being further configured to produce a sensor signal corresponding to the amplitude of the sensed electrical current;

an alert; and a control device coupled with the sensing circuitry and with the alert, the control device being configured to;

compare a differentiated value of the sensor signal with a predefined value;

produce a spark detection signal based on the comparison;

produce a control signal based on the spark detection signal;

perform at least one of, activating the alert or flagging the sparkplug for service, based on the control signal; wherein the control device is further configured to: clock a time duration from energizing the ignition circuitry to the production of the spark; and produce the control signal based on the clocked time duration.

7. The system of claim 6 wherein the control device is further configured to set a flag for servicing the sparkplug based on the control signal.

8. The system of claim 6 wherein the sensing circuitry further includes a first differentiator configured to differentiate the sensor signal.

9. The system of claim 8 wherein the sensing circuitry includes a second differentiator coupled in series with the first differentiator so as to calculate a second derivative of the sensor signal.

10. The system of claim 9 further comprising a comparator coupled with the second differentiator and having a comparator output dependent upon a value of the second derivative.

11. The system of claim 10 wherein the comparator has an output, and is configured to toggle the output based on a second derivative value of approximately zero.

12. An engine ignition system comprising:

a fluid conduit configured to convey a mixture of a fuel and air for combustion;

a sparkplug including electrodes forming a spark gap positioned within the fluid conduit; and an ignition control system including:

a primary ignition circuitry including an electrical input configured to couple with an electrical energy supply, and a first electrical output and a second electrical output, and a primary ignition coil connected to the first and the second electrical outputs;

a secondary ignition circuitry coupled with the electrodes, and including a secondary ignition coil energized by way of inductive coupling of the primary ignition coil to the secondary ignition coil;

sensing circuitry connected to the primary ignition circuitry and configured to sense an electrical property, of the primary ignition circuitry that varies in amplitude based on production of a spark between the electrodes;

the varying in amplitude including a pattern of decreasing and then increasing amplitude that is indicative of a timing of the spark production, and the sensing circuitry being further configured to produce a sensor signal corresponding to the amplitude of the sensed electrical current an alert; and a control device coupled with the sensing circuitry and with the alert, the control device being configured to:

compare a differentiated value of the sensor signal with a predefined value;

produce a spark detection signal based on the comparison;

produce a control signal indicative of an aging state of the sparkplug based on the spark detection signal; and activate the alert based on the control signal; wherein the control device is further configured to: clock a time duration from energizing the ignition circuitry to the production of the spark; and produce the control signal based on the clocked time duration.

13. The system of claim 12 wherein the fluid conduit includes an intake runner in a combustion engine, and the fluid conduit is configured to convey a gaseous fuel to a cylinder in an internal combustion engine.

* * * * *